US009683529B2

(12) United States Patent
Kato et al.

(10) Patent No.: US 9,683,529 B2
(45) Date of Patent: Jun. 20, 2017

(54) METHOD FOR MANUFACTURING INTAKE MANIFOLD AND INTAKE MANIFOLD

(71) Applicants: FUJI JUKOGYO KABUSHIKI KAISHA, Tokyo (JP); TOYOTA BOSHOKU KABUSHIKI KAISHA, Aichi-ken (JP)

(72) Inventors: Jumpei Kato, Kawasaki (JP); Naoki Kato, Fuchu (JP); Takuma Yamaguchi, Nagoya (JP)

(73) Assignees: FUJI JUKOGYO KABUSHIKI KAISHA, Tokyo (JP); TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 14/275,000

(22) Filed: May 12, 2014

(65) Prior Publication Data

US 2014/0338629 A1 Nov. 20, 2014

(30) Foreign Application Priority Data

May 15, 2013 (JP) ..... 2013-103259

(51) Int. Cl.
*F02M 35/10* (2006.01)
*F02M 35/104* (2006.01)

(52) U.S. Cl.
CPC .... *F02M 35/10354* (2013.01); *F02M 35/104* (2013.01); *F02M 35/10321* (2013.01); *Y10T 29/49229* (2015.01)

(58) Field of Classification Search
CPC ..... F02M 35/10321; F02M 35/10347; F02M 35/10354; F02M 35/1036; F02M 35/10039; F02M 35/1034; F02M 35/104
(Continued)

(56) References Cited

U.S. PATENT DOCUMENTS 5,623,904 A * 4/1997 Matsumoto ..... F01L 1/265 123/339.23
5,928,453 A * 7/1999 Kawamoto ..... B29C 65/1412 156/272.2

(Continued)

FOREIGN PATENT DOCUMENTS

CN 102337996 2/2001
CN 102555107 7/2012

(Continued)

OTHER PUBLICATIONS

Office Action issued in China Counterpart Patent Appl. No. 201410201135.4, dated Jan. 28, 2016 , along with an English translation thereof.

(Continued)

*Primary Examiner* — Marguerite McMahon
*Assistant Examiner* — James Kim
(74) *Attorney, Agent, or Firm* — Greenblum & Bernstein, P.L.C.

(57) ABSTRACT

A method for manufacturing an intake manifold is provided that is capable of suppressing deterioration in the dimensional accuracy by correcting warping and deformation caused during molding. When an intake manifold that is made of plastic and has a surge tank and intake pipes extending from the surge tank is manufactured, distal members, which form the distal ends of the intake pipes, are positioned on a jig. In this state, the distal members and the main bodies of the intake pipes are fixed to each other by vibration-welding.

7 Claims, 3 Drawing Sheets

(58) Field of Classification Search
USPC ..... 123/184.61, 184.24, 184.42, 184.56
See application file for complete search history.

(56) References Cited

U.S. PATENT DOCUMENTS

| | | | | |
|---|---|---|---|---|
| 6,776,132 | B2 * | 8/2004 | Kudo | F02M 35/10111 123/184.42 |
| 7,017,543 | B2 | 3/2006 | Menin | |
| 7,581,522 | B2 * | 9/2009 | Enokida | F02M 35/10039 123/184.34 |
| 8,677,972 | B2 * | 3/2014 | Kim | F02M 35/10216 123/184.61 |
| 2004/0200450 | A1 * | 10/2004 | Tanikawa | B29C 65/06 123/184.42 |
| 2006/0048740 | A1 | 3/2006 | Tanikawa et al. | |
| 2007/0246009 | A1 * | 10/2007 | Suzuki | F02B 31/04 123/336 |
| 2009/0133659 | A1 * | 5/2009 | Iwata | F02M 35/10144 123/184.61 |
| 2010/0242892 | A1 * | 9/2010 | Takakuwa | F02M 35/10039 123/184.53 |
| 2012/0021179 | A1 * | 1/2012 | Ohta | B29C 65/069 428/156 |

FOREIGN PATENT DOCUMENTS

| | | |
|---|---|---|
| JP | 62-99665 | 5/1987 |
| JP | 2002-364471 | 12/2002 |
| JP | 2004-308604 | 11/2004 |
| JP | 2008-190331 | 8/2008 |
| JP | 2008-297908 | 12/2008 |

OTHER PUBLICATIONS

Office Action issued in Japan Counterpart Patent Appl. No. 2013-103259, dated Jul. 27, 2016 , along with an English translation thereof.
Office Action issued in Japan Counterpart Patent Appl. No. 2013-103259, dated Nov. 15, 2016 , along with an English translation thereof.

* cited by examiner

METHOD FOR MANUFACTURING INTAKE MANIFOLD AND INTAKE MANIFOLD

BACKGROUND OF THE INVENTION

The present invention relates to a method for manufacturing an intake manifold, which forms a part of an intake system of an automobile engine, and an intake manifold.

Conventionally, the structure of an intake manifold shown in FIG. 4 is known. The conventional structure is for a horizontally opposed engine. In this conventional structure, an intake manifold 41 is entirely made of a heat-resistant plastic and includes a central surge tank 42 and intake pipes 43 extending in curved shapes from opposite sides of the surge tank 42. The surge tank 42 and the intake pipes 43 of the intake manifold 41 are formed by a main portion 411 having an upper opening and a cap portion 412 closing the opening of the main portion 411. The main portion 411 and the cap portion 412 are both formed of plastic, and the cap portion 412 is fixed to the opening of the main portion 411, for example, by vibration welding, so that the intake manifold 41, which has the surge tank 42 and the intake pipes 43, is formed.

Another example of conventional intake manifolds is disclosed in Japanese Laid-Open Patent Publication No. 62-99665. In this conventional structure, the distal ends of intake pipes are attached to the main body of an engine via an intake passage block. The intake pipes and the intake passage block have connection flanges at the facing ends. With a gasket arranged between the connection flanges, each intake pipe and the intake passage block are connected and fixed to each other with bolts.

The intake manifolds of the above described conventional configurations have the following drawbacks. In the conventional configuration of FIG. 4, since the intake manifold 41 is entirely formed of plastic, and the intake pipes 43 extend in a curved manner from both sides of the surge tank 42, the ends of the intake pipes 43 are likely to be warped upward or deformed during molding. That is, in some cases, warping W as shown in FIG. 5 is caused at distal attachment surfaces 431 of the intake pipes 43 on the opposite sides. In other cases, as shown in FIG. 6, the measurement L1 between the intake pipes 43 on the opposite sides deviates from a specified measurement L2. Further, as shown in FIG. 7, a height difference S is caused between the distal attachment surfaces 431 of the intake pipes 43 on the opposite sides in other cases. The longer the intake pipes 43 on the opposite sides of the surge tank 42, the more likely such warping and deformation are to occur. Further, in the case in which the surge tank 42 and the intake pipes 43 of the intake manifold 41 are formed by the main portion 411 and the cap portion 412, warping and deformation are even more likely to occur because of the upper opening of the main portion 411 during molding of the main portion 411.

To reduce warping and deformation occurring in the intake pipes 43 during molding, ribs may be formed on the outer surface of a part of each intake pipe that is located in a position to be extended by warping. However, if the intake pipes 43 have such ribs, the shape of the molding die would be complicated. Further, the molded intake manifold would have a complicated structure, and the ribs would create fins. The fins become relatively thick in some cases so that sink marks are formed due to thickness differences.

The conventional configuration disclosed in Japanese Laid-Open Patent Publication No. 62-99665 is a structure in which an intake passage block is connected to the distal ends of intake pipes of an intake manifold for a horizontally opposed engine. However, the document has no disclosure regarding the type of the material used for the intake manifold. Accordingly, drawbacks caused by the material of the intake manifold are not disclosed.

The present invention was made for solving the above problems in the prior art. It is an objective of the present invention to provide a method for manufacturing a plastic intake manifold and an intake manifold that, when distal members are secured to the distal ends of intake pipes, limit adverse influence of warping and deformation of intake pipes caused during molding.

SUMMARY OF THE INVENTION

To achieve the foregoing objective, one aspect of the present invention provides a method for manufacturing an intake manifold that is made of plastic and has a surge tank and intake pipes extending from the surge tank. The method includes: positioning distal members, which form distal ends of the intake pipes, on a jig; and fixing the distal members and main bodies of the intake pipes to each other after the positioning of the distal members.

DETAILED DESCRIPTION OF THE PREFERRED EMBODIMENTS

A method for manufacturing an intake manifold and an intake manifold according to one embodiment will now be described with reference to the drawings. First, the structure of an intake manifold for a horizontally opposed four cylinder engine will be described. The present embodiment will be described. In the description, the right-and-left direction in FIG. 1 is defined as the right-and-left direction of an intake manifold, and the direction perpendicular to the sheet of FIG. 1 is defined as the front-rear direction of the intake manifold.

Figure 1:
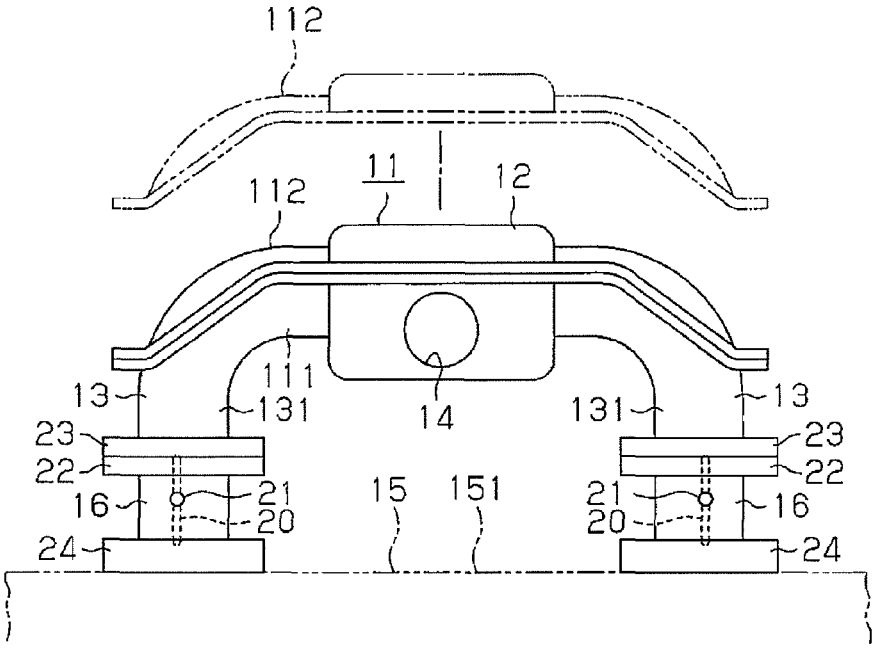
FIG. 1 is a front view showing an intake manifold according to one embodiment.
Figure 2:
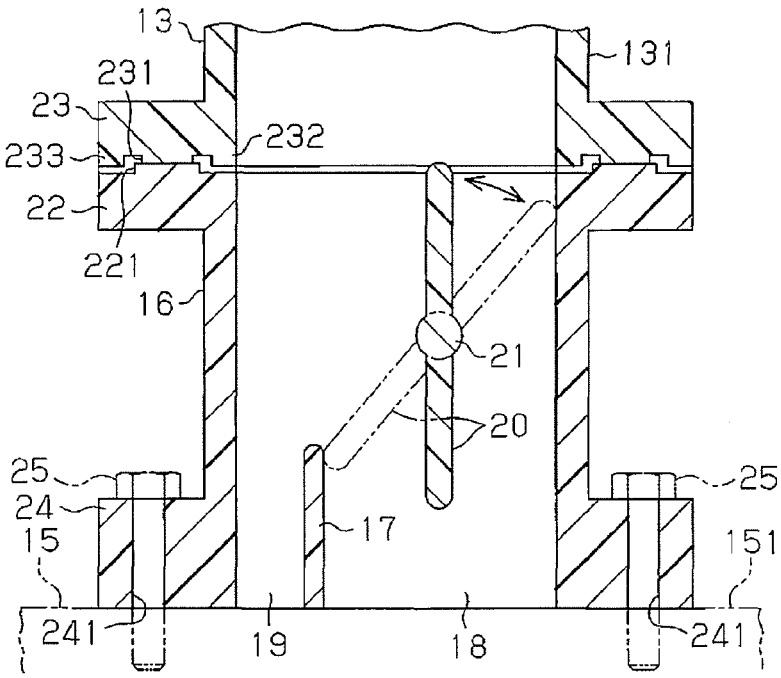
FIG. 2 is an enlarged cross-sectional view illustrating a distal portion of an intake pipe of the intake manifold shown in FIG. 1.
Figure 3:
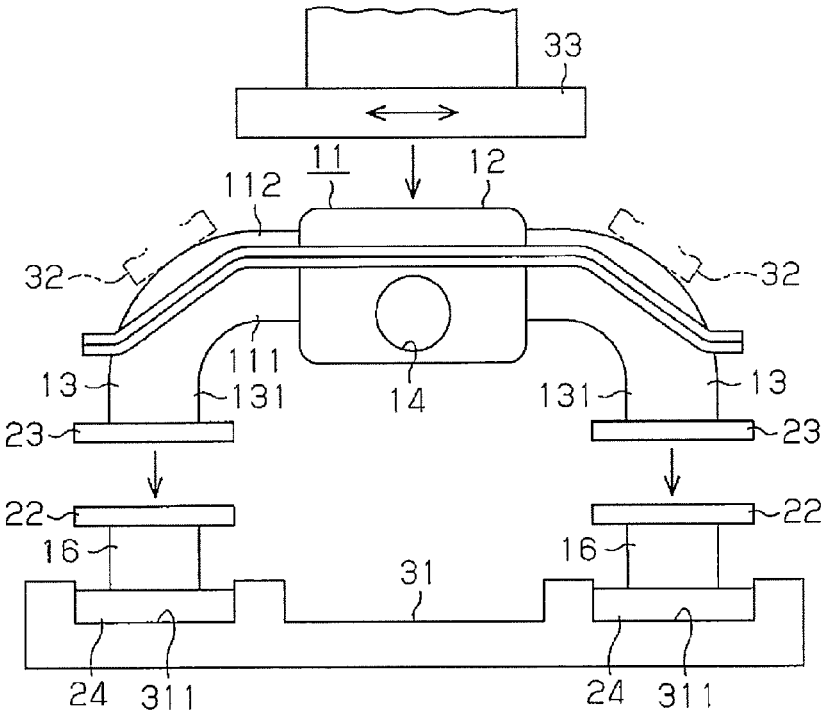
FIG. 3 is a front view showing a method for manufacturing the intake manifold shown in FIG. 1.
Figure 4:
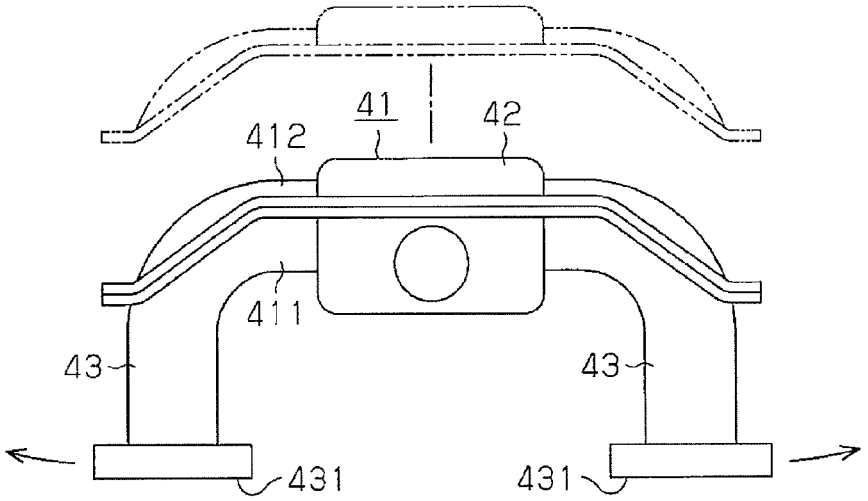
Fig.4(Prior Art)
FIG. 4 is a front view showing a conventional intake manifold.
Figure 5:
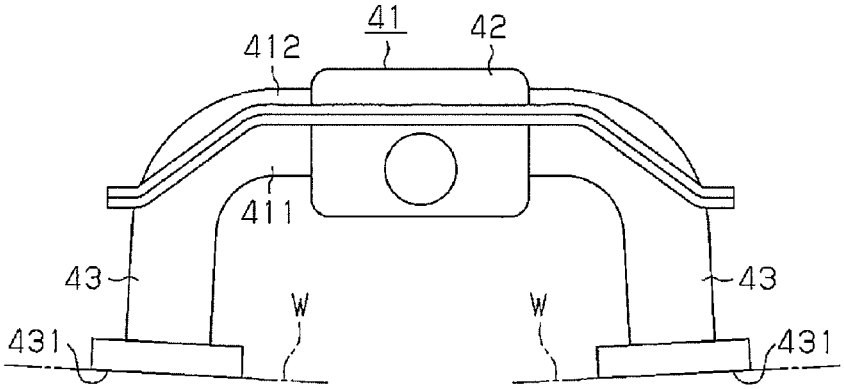
Fig.5(Prior Art)
FIG. 5 is a front view showing a case in which warping is caused at the right and left attachment surfaces during manufacture of the intake manifold shown in FIG. 4.
Figure 6:
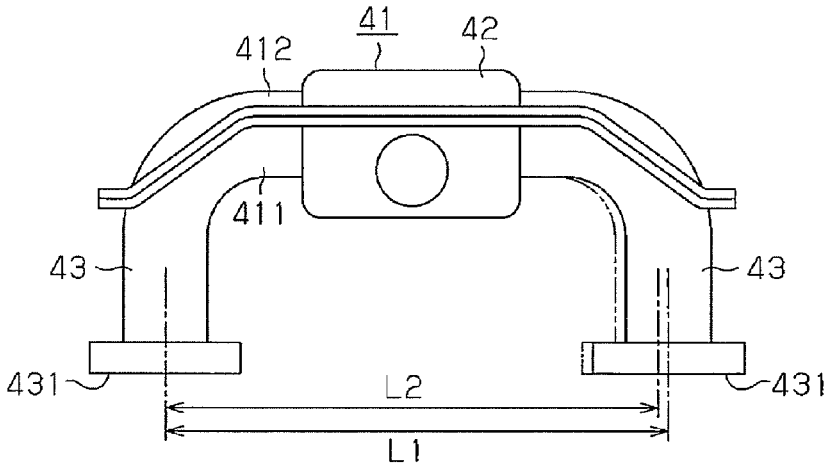
Fig.6(Prior Art)
FIG. 6 is a front view showing a case in which the measurement between the right and left intake pipes has an error during manufacture of the conventional intake manifold.
Figure 7:
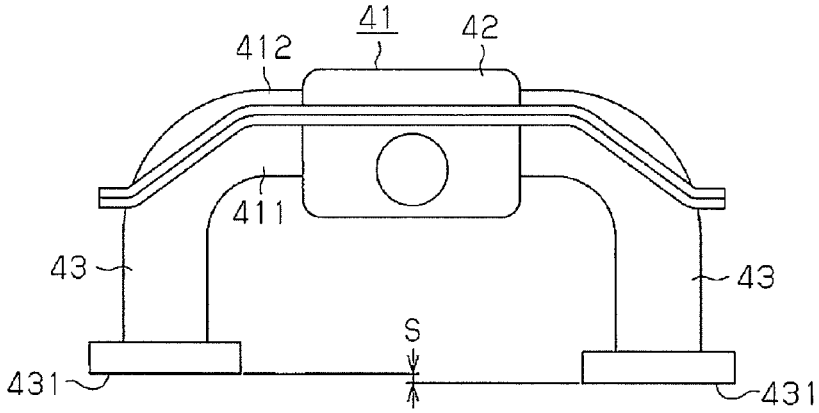
Fig.7(Prior Art)
FIG. 7 is a front view showing a case in which a height difference is caused between the right and left attachment surfaces during manufacture of the conventional intake manifold.

An intake manifold 11 illustrated in FIGS. 1 to 3 is entirely made of a heat-resistant plastic such as polyamide plastic.

As shown in FIG. 1, the intake manifold 11 has a surge tank 12 at the center. The intake manifold 11 also has downwardly curved intake pipes 13 extending from the right and left sides of the surge tank 12 substantially in a bilaterally symmetric manner.

As shown in FIGS. 1 and 2, the surge tank 12 has in the front face a connection port 14 for taking in air. The connection port 14 is connected to an air duct (not shown) that conducts air filtered by an air cleaner (not shown) into the surge tank 12. The intake pipes 13 are provided in right and left pairs to correspond to right and left pairs of combustion chambers of a horizontally opposed engine 15. The air in the surge tank 12 is supplied to the combustion chambers of the engine 15 via the intake pipes 13.

As shown in FIG. 1, the surge tank 12 and the intake pipes 13 of the intake manifold 11 are formed by a main portion 111 and a cap portion 112, which are separate components. The main portion 111 opens upward, and the cap portion 112 opens downward. The connection port 14 of the surge tank 12 is formed in the front face of the main portion 111. The cap portion 112 is fixed to the opening of the main portion 111 by vibration welding, so that the surge tank 12 and the intake pipes 13 are integrated.

As shown in FIGS. 1 and 2, each intake pipe 13 of the intake manifold 11 includes a main body 131 extending from the surge tank 12 and a distal member 16, which is separately formed from the main body 131 and forms the distal portion of the intake pipe 13. The distal member 16 is made of a heat-resistant plastic such as polyamide plastic and has a short cylindrical shape. The material of the distal member 16 is preferably the same as that of the main body 131 and has the same molecular weight. The distal member 16 is fixed to the distal end of the main body 131 by vibration welding to form an intake pipe 13 having a predetermined length.

As shown in FIG. 2, a partition 17 is formed in the distal member 16. The partition 17 defines a first flow channel 18 and a second flow channel 19 inside the distal member 16. With respect to the right and left of the intake manifold 11, the first flow channel 18 is located on the outer side, and the second flow channel 19 is located on the inner side. The cross-sectional area of the first flow channel 18 is set to be larger than the cross-sectional area of the second flow channel 19. A flow rate adjuster valve 20, which is rotational via a valve shaft 21, is arranged in the first flow channel 18 of each distal member 16. The valve shaft 21 is rotated by an actuator (not shown) such that the flow rate adjuster valve 20 is switched between a position for opening the first flow channel 18 and a position for closing the first flow channel 18, as indicated by solid lines and a chain line in FIG. 2. Accordingly, the flow rate and the flow velocity of air supplied to the combustion chambers of the engine 15 via the intake pipes 13 is adjusted in accordance with parameters such as the engine load.

As shown in FIG. 2, the distal member 16 has a protruding flange 22 at the periphery of the upper end. The flange 22 has on its top a protrusion 221, which serves as a weld portion. The main body 131 of the intake pipe 13 has, at the periphery of the lower end, a protruding flange 23, which corresponds to the flange 22 of the distal member 16. The flange 23 has at the center on its lower surface a protrusion 231, which serves as a weld portion to be joined to the protrusion 221 of the distal member 16. The flange 23 also has ribs 232, 233 at the inner and outer peripheries on the lower face, respectively. The ribs 232, 233 are spaced from the protrusion 231.

With the protrusions 221, 231 of the flanges 22, 23 joined to each other, the intake pipes 13 and the distal member 16 are vibrated to move relative to each other. This causes friction between the protrusions 221, 231, resulting in frictional heat. The joined parts are melted and fixed to each other. That is, the lower end of the main body 131 of the intake pipes 13 and the upper end of the distal member 16 are fixed to be integral through the vibration welding between the protrusions 221, 231, which serve as weld portions.

As shown in FIG. 2, the distal member 16 of the intake pipe 13 has an attachment base 24 formed at the outer periphery of the lower end. The attachment base 24 has bolt insertion holes 241. Bolts 25 are threaded into a cylinder block 151 of the engine 15 through the bolt insertion holes 241 from above the attachment base 24, so that the intake manifold 11 is attached to the top of the cylinder block 151.

A method for manufacturing an intake manifold having the above described structure will now be described.

When manufacturing the intake manifold 11, the main portion 111, the cap portion 112, and the distal members 16 are separately formed of plastic. The cap 112 is fixed to the upper opening of the main portion 111 by vibration welding, so that the intake manifold 11 having the cap portion 112 and the main bodies 131 of the intake pipes 13 is formed. Thereafter, the distal members 16 are fixed to the distal ends of the main bodies 131 of the intake pipes 13 by vibration welding to form the intake pipes 13 each having a predetermined length.

That is, as shown in FIG. 3, with the distal members 16 positioned at positioning recesses 311 on a jig 31, the main bodies 131 of the intake pipes 13 are arranged to be joined to the distal members 16. While the curved parts of the main bodies 131 of the intake pipes 13 are held by holding members 32 so as not to rise, a vibration portion 33 of a vibration welding machine applies vibration to a part of the surge tank 12, such that the distal members 16 are welded and fixed to the main bodies 131 of the intake pipes 13.

At the molding of the main portion 111 and the vibration welding of the cap portion 112 to the main portion 111, the main bodies 131 of the intake pipes 13, which extend from both sides of the surge tank 12, are likely to be warped or deformed. However, even if the main bodies 131 of the intake pipes 13 are warped or deformed, a required attachment dimensional accuracy of the cylinder block 151 of the engine 15 is ensured since the positions of the distal members 16 are determined with respect to the main bodies 131 during the vibration welding.

That is, the intake manifold 11 of the present embodiment has a structure in which the intake pipes 13 are formed by attaching the distal members 16 to the main bodies 131 of the intake pipes 13. This allows the main body 131 to have a shorter length by the amount corresponding to the distal member 16. In this case, the distal members 16 are practically free of any drawbacks related to warping or deformation. Further, being relatively short, the main bodies 131 have small amounts of warping and deformation. Therefore, each intake pipe 13 as a whole can be accurately formed with small amounts of warping and deformation. Further, since the distal members 16 are positioned by the jig 31 and the cap portion 112 is held by the holding members 32 when the vibration welding is performed, the welding of the main bodies 131 and the distal members 16 can be performed while maintaining the accurate positional relationship even if the main bodies 131 have warping and deformation.

The intake manifold 11, to which the distal members 16 are welded, is fixed by the bolts 25 with the distal members 16 joined to the cylinder block 151 of the engine 15.

The present embodiment therefore has the following advantages.

(1) The present embodiment provides a method for manufacturing the plastic intake manifold 11, which includes intake pipes 13 extending from the surge tank 12. According to the method, the distal members 16, which form the distal ends of the intake pipes 13, are positioned on the jig 31 when the distal members 16 and the main bodies 131 of the intake pipes 13 are fixed to each other.

Therefore, even if the main bodies 131 of the intake pipes 13 have warping or deformation at the molding process, the distal members 16 are fixed while being positioned relative to the main bodies 131 of the intake pipes 13. Thus, the welding can be performed with accuracy. Accordingly, the dimensional accuracy is prevented from deteriorating due to the molding of the intake manifold 11. This prevents the performance of the engine from being degraded due to deteriorated dimensional accuracy.

Since the distal portions of the intake pipes 13 are formed by the distal members 16, which are separate components, the amount of extension of the main bodies 131 of the intake pipes 13 from the surge tank 12 is relatively short. This reduces warping and deformation occurring in the main bodies 131. Since no ribs for suppressing warping and deformation need to be formed at the outer periphery of the intake pipes 13, the structure of the molding die can be simplified. In addition, the molded intake manifold 11 has a simple structure and therefore has a small amount of fins, so that the weight of the intake manifold 11 and sink marks are reduced.

(2) In the present embodiment, the distal members 16 and the main bodies 131 are vibration-welded to each other. Therefore, the main bodies 131 of the intake pipes 13 and the distal members 16 can be easily and firmly fixed to each other without using adhesive or other members such as bolts.

(3) In the present embodiment, the intake pipes 13 and the surge tank 12 are formed by the main portion 111 and the cap portion 112, which is fixed to close the opening of the main portion 111. Therefore, although the structure with the upper opening of the main portion 111 makes warping and deformation to be easily occur during the molding of the main portion 111, the distal members 16 reduce warping and deformation of the main bodies 131 of the intake pipes 13, so that accuracy is ensured.

(4) In the present embodiment, the distal members 16 are vibration-welded to the main bodies 131 after the cap portion 112 is vibration-welded to the main portion 111. In this manner, after the vibration welding of the cap portion 112 to the main portion 111, the distal members 16 are vibration-welded to the main bodies 131 of the intake pipes 13. Thus, even if the main portion 111 and the cap portion 112 have warping or deformation, the distal members 16 can be vibration-welded to the main bodies 131 of the intake pipes 13 without being influenced by the warping or deformation.

Modifications

The above described embodiment may be modified as described below.

The main bodies 131 of the intake pipes 13 and the distal members 16 may be fixed to each other by a fixing method other than vibration welding, for example, by using adhesive or bolts.

The main portion 111 and the cap portion 112 of the intake manifold 11 may be fixed to each other by a fixing method other than vibration welding, for example, by using adhesive or bolts.

The partitions 17 and the flow rate adjuster valve 20 in the distal member 16 may be omitted.

The present embodiment may be applied to an intake manifold for an engine of a type other than a horizontally opposed engine, for example, may be applied to an intake manifold of a V-engine. The intake manifold for a V-engine is located between the banks.

The invention claimed is:

1. A method for manufacturing an intake manifold that is made of plastic and has a surge tank and intake pipes extending from the surge tank, the method comprising:

forming the surge tank and the intake pipes from a main portion and a cap portion by fixing the main portion and the cap portion together at a joint line that defines an interface between the main portion and the cap portion, wherein the main portion includes main bodies of the intake pipes extending downwardly from a position below the joint line, providing distal members each of which comprises a cylindrical portion, a first end surface, and a second end surface, wherein the first end surface and the second end surface is provided at opposing ends of the cylindrical portion, wherein the distal members are spacers, positioning the distal members, which form distal ends of the intake pipes, on a jig; and fixing the first end surfaces of the distal members and ends of the main bodies of the intake pipes to each other after the positioning of the distal members, wherein the distal members are provided separately from the main bodies of the intake pipes prior to the fixing, wherein the second end surfaces of the distal members are configured to be mounted on an engine, the main portion and the cap portion being fixed to each other by a first vibration-welding prior to the positioning of the distal member, the first end surfaces of the distal members and ends of the main bodies of the intake pipes being fixed to each other by a second vibration-welding, and wherein the second vibration-welding is performed by a vibration portion of a vibration welding machine that applies vibration to the surge tank while the main body of the intake pipe is held by a holding member, which is provided separately from the vibration portion.

2. The method for manufacturing an intake manifold according to claim 1, wherein two or more of the intake pipes are provided on each of opposite sides of the surge tank.

3. The method for manufacturing an intake manifold according to claim 2, wherein the main portion has an opening that is closed by the cap portion.

4. An intake manifold that is manufactured by the manufacturing method according to claim 1.

5. An intake manifold that is manufactured by the manufacturing method according to claim 2.

6. An intake manifold that is manufactured by the manufacturing method according to claim 3.

7. An intake manifold that is manufactured by the manufacturing method according to claim 3.

* * * * *